US007077550B2

(12) United States Patent
Egashira

(10) Patent No.: US 7,077,550 B2
(45) Date of Patent: Jul. 18, 2006

(54) AUTOMOTIVE LAMP WITH LIGHT TRANSMISSIVE COLORED MEMBER

(75) Inventor: Ken Egashira, Kanagawa (JP)

(73) Assignee: 3M Innovative Properties Company, St. Paul, MN (US)

( * ) Notice: Subject to any disclaimer, the term of this patent is extended or adjusted under 35 U.S.C. 154(b) by 162 days.

(21) Appl. No.: 10/492,830

(22) PCT Filed: Nov. 1, 2002

(86) PCT No.: PCT/US02/35036

§ 371 (c)(1),
(2), (4) Date: Apr. 15, 2004

(87) PCT Pub. No.: WO03/040614

PCT Pub. Date: May 15, 2003

(65) Prior Publication Data

US 2004/0217856 A1 Nov. 4, 2004

(30) Foreign Application Priority Data

Nov. 2, 2001 (JP) ..... 2001-337937

(51) Int. Cl.
*F21V 13/08* (2006.01)
*F21V 9/08* (2006.01)

(52) U.S. Cl. ..... 362/510; 362/293; 362/307; 362/311

(58) Field of Classification Search ..... 362/510, 362/293, 307, 311, 487, 520
See application file for complete search history.

(56) References Cited

U.S. PATENT DOCUMENTS

| | | | | |
|---|---|---|---|---|
| 2,252,324 | A | 8/1941 | Land | |
| 2,748,659 | A | 8/1956 | Goffcken et al. | |
| 2,887,566 | A | 5/1959 | Marks | |
| 3,000,774 | A * | 9/1961 | Swedlow et al. | 362/605 |
| 3,513,305 | A | 5/1970 | Joncas | |
| 4,912,606 | A * | 3/1990 | Yamamoto | 362/518 |
| 5,001,610 | A * | 3/1991 | Otaka | 362/510 |
| 5,571,277 | A * | 11/1996 | Allred et al. | 362/293 |
| 5,931,566 | A * | 8/1999 | Fraizer | 362/293 |
| 5,933,084 | A | 8/1999 | Ravier et al. | |
| 6,267,490 | B1 | 7/2001 | Funada | |
| 6,409,368 | B1 * | 6/2002 | Henneboehle et al. | 362/510 |

FOREIGN PATENT DOCUMENTS

| | | |
|---|---|---|
| EP | 0 860 652 | 8/1998 |
| FR | 2 639 285 | 5/1990 |
| FR | 2 755 077 | 4/1998 |
| JP | 10-241415 | 9/1998 |

* cited by examiner

*Primary Examiner*—Alan Cariaso
(74) *Attorney, Agent, or Firm*—Harold C. Knecht, III

(57) ABSTRACT

An automotive lamp having an excellent outer design along with a simple structure and easy production. The automotive lamp can comprise a light source (21), a housing (22), a light-emitting opening and a light-transmissive lamp cover (23), in which a non-light-emitting area of the lamp cover, which does not substantially concern the emission of the light generated from the light source (21), is provided with a light transmissive colored member (10) through which, under unlit conditions, outer light is transmitted to the housing (22), to thereby reflect the transmitted light at the inner wall of the housing (22) and emit the colored and reflected light out of the housing (22).

15 Claims, 2 Drawing Sheets

AUTOMOTIVE LAMP WITH LIGHT TRANSMISSIVE COLORED MEMBER

FIELD OF THE INVENTION

The present invention relates to a lamp, and more particularly to an automotive lamp which, under unlit conditions, appears colored in the interior with incoming external light, and which has thereby achieved remarkably improved appearance and design.

BACKGROUND OF THE INVENTION

As is well known, an automotive lamp typically comprises a housing provided with a light-emitting opening in a front area, a plate-shaped or lens-shaped lamp cover which covers the light-emitting opening, and a light source disposed in a lamp chamber defined by the housing and the lamp cover. An inner wall of the housing is provided with an integral reflective layer or an independent reflector. In such an automotive lamp, when the light source is lighted, direct light generated from the light source and reflected light from the inner wall of the housing are together emitted through the lamp cover to accomplish the intended lighting function.

In recent years, however, not only the proper lighting function during lit conditions (i.e., when the lamp is on), but also improved outer appearance in the daylight is increasingly required of such an automotive lamp. In particular, in order to achieve glistening effect and deep clear view into the interior, it is a general practice, especially with a head lamp, to form a reflective layer on the inner wall of the housing in metallic tone by vapor deposition of aluminum, to design the surface so as to control the light path, and to form the lamp cover with a resin cover which is flat and smooth both on front and back surfaces and which has no lens function.

In above-mentioned lamp, however, improvement of the outer appearance relies solely on the combination of a deposited reflective film and a resin cover, and as a result, obtained appearance is unavoidably limited to a metallic tone (or, a silver color). In order to obtain colored outer appearance, coloring of the inner wall, the reflector or the lamp cover itself, is proposed. However, as a result of coloring, violation of the regulation governing color of vehicle lamp, for example, violation of the Safety Regulation for Road Vehicles, may happen.

Coating the portion of the reflector which does not contribute to reflection of irradiated light with coloring paint, a method adopted in some automotive lamp, has a drawback that it requires complicated process of coating or painting, and it is difficult to perform uniform coating on the reflector which has often a complicated three-dimensional shape. Actually, it is possible to obtain only very faint color in such coating.

Japanese Unexamined Patent Publication (Kokai) No. 10-241415, as shown in FIG. 1, discloses an automotive signal lamp comprising a reflector 32 and an outer cover 38, wherein optical distribution of light emitted from a signal lamp 30 is controlled by the reflector 32. In this automotive signal lamp, a non-transparent mask 34 is disposed between the reflector 32 and the outer cover 38, and the mask 34 is provided with a central opening 36 such that light from the reflector 32 passes through the central opening 36 and reaches the outer cover 38, and a concave reflective surface 40 that is covered with a clear colored layer 42 and is disposed so that it reflects light L incident from outside. Colored appearance can be obtained using this automotive signal lamp. However, since two reflectors have to be actually arranged, the structure is unavoidably complex and manufacturing process is also complicated accordingly, leading to increase of cost and overall size.

SUMMARY OF THE INVENTION

It is therefore an object of the present invention to solve one or more problems in the art. For example, it can be an object of the present invention to provide an automotive lamp which complies with current regulations, is excellent in appearance and design, and is simple in construction and easy to be manufactured.

In one aspect of the present invention, an automotive lamp is provided that comprises a light source, a housing provided with an inner wall capable of reflecting light from the light source, a light-emitting opening provided in front area of the housing, and a light-transmissive lamp cover mounted on the light-emitting opening, characterized in that a non-light-emitting area of the lamp cover, which does not substantially concern the emission of the light generated from the light source, is provided with a light-transmissive colored member through which, under unlit conditions (i.e., when the lamp is off), outer light is transmitted to the housing, to thereby reflect the transmitted light at the inner wall of the housing, and emit the colored and reflected light out of the housing.

DETAILED DESCRIPTION OF THE INVENTION

An automotive lamp of the present invention may be used in various fields as lighting means, sign means, signal means, etc., and as such, is not specially limited in basic form as long as the lamp comprises a light source, a housing provided with an inner wall capable of reflecting light from the light source, a light emitting opening, and a lamp cover mounted in the light emitting opening. Examples of such an automotive lamp include, but are not limited to, a head lamp, a fog lamp, a clearance lamp, a stop lamp, a tail lamp, a turn signal lamp, a back-up lamp. The automotive lamp may take the form of a combination lamp in which a plurality of lamps are combined, and may be used as a rear combination lamp in rear area or as a front combination lamp in the front area of a vehicle. Among them, a head lamp is suitable for the lamp.

Vehicles with which the lamp of the present invention may be used are not particularly limited, and include an automobile (including RV car, camping car, and the like), a bus, a truck, etc. An automobile is an especially suitable vehicle for application of the present invention, since improvement can be obtained in outer appearance and design.

Figure 1:
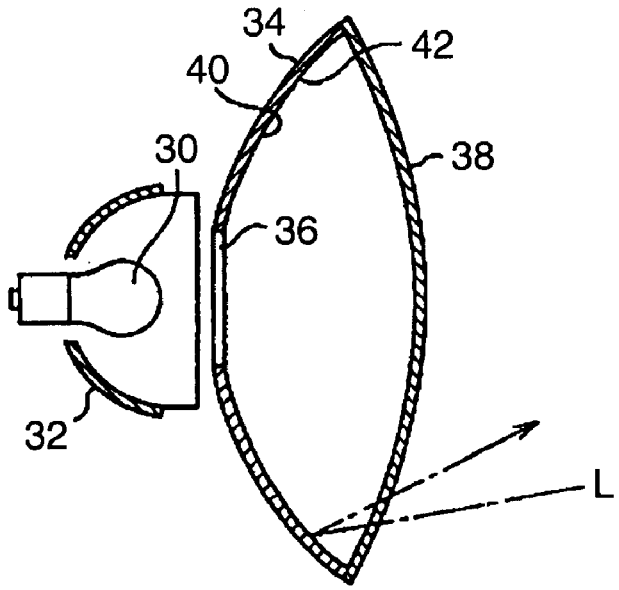
FIG. 1 PRIOR ART
FIG. 1 is a cross-sectional view showing an example of conventional automotive lamp.
Figure 2:
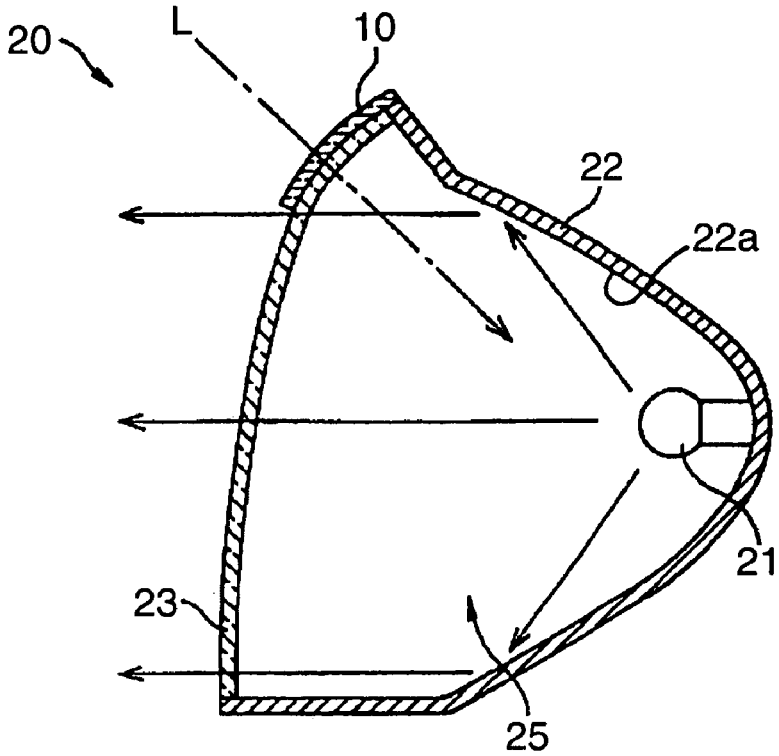
FIG. 2 is a cross-sectional view schematically showing an automotive lamp according to an example of the present invention.

FIG. 2 is a view showing general construction of an automotive lamp of the present invention. The lamp 20 comprises a lamp chamber 25 defined by a housing 22 and a lamp cover 23 mounted so as to cover a light-emitting opening (light-emitting area) in the front area. The lamp chamber 25 may be composed of two or more chambers as necessary. Each of these lamp chambers may be independent of each other, or may communicate with each other. In a lamp chamber, usually, a light source 21 of suitable luminance is disposed in a position fitted into a socket (not shown). Although one light source 21 is disposed in the chamber in the illustrated example, two or more lamps 21 may be disposed in one lamp chamber, if necessary.

An inner wall 22*a* of the housing 22 has a reflective film structure like a concave mirror so as to collimate light generated from the light source 21. Such a reflective film structure can be formed, for example, by vapor deposition of aluminum in a thin film of metallic appearance. In accordance with another aspect of the present invention, aside from the inner wall, a concave mirror or similar light reflecting means (usually, a reflector) may be provided in the lamp chamber 25. The light source 21 may have a cap colored in a predetermined color as necessary, since, when colored cap is used, a colorless cover can be used as a lamp cover in place of a colored cover.

In line with the recent tendency toward improving the appearance and design, the lamp cover 23 is provided with a non-light-emitting area, that is, a non-light-transmissive area which does not substantially concern emission of light generated from the light source 21. In the non-light-emitting area, in accordance with the present invention, a light-transmissive colored member (in the illustrated example, a colored film) 10 is disposed. In the illustrated example, a colored film 10 is adhered to an outer surface of the lamp cover 23. But, in the present invention as described below, it may be adhered to an inner surface. Also, other colored member may be used.

In the automotive lamp of the present invention, the light-emitting opening (light-emitting area and neighboring non-light-emitting area) is provided with a lamp cover. The lamp cover is not particularly limited as long as it has the shape and size capable of covering at least the light-emitting surface of the lamp chamber. But, in general, it is in the form of a circle, a rectangle, or a square, and may sometimes take other variant forms such as an ellipse or a L-shape.

The lamp cover may be colorless, or may be colored as required, that is, in accordance with the hue of light emitted therefrom. In the case where the lamp chamber is a combination of two or more chambers, it may be colored in different hue for different chambers.

The colorless or colored lamp cover may be advantageously formed by molding of an optional light transmissive resin. Suitable molding methods include ordinary molding method such as injection molding, vacuum molding, etc. Resin raw materials that can be used include, but are not limited to, styrene resins, hard vinyl chloride resins, acrylic resins, polycarbonate resins, etc. In particular, an acrylic resin can be advantageously used, since it is excellent in strength and transparency, and coloring process can be performed advantageously. If necessary, the lamp cover may be formed from glass or other transparent material.

When a colored lamp cover is fabricated, suitable amount of coloring agent may be mixed into aforementioned resin raw material. Suitable coloring agents include, but are not limited to, pigments such as perylene pigment, azo pigment, ferrous oxide, etc., and dyes such as quinophthalone dye, azo dye, disazo dye, anthraquinone dye, benzopyrane dye (all from Color Index).

In fabricating the lamp cover, in addition to a coloring agent, ordinary additives used in the field of plastic molding may be mixed with the resin raw material. Suitable additives include, for example, UV absorbers, light stabilizers, heat stabilizers, etc. For example, suitable UV absorbers include, but are not limited to, benzotriazole UV absorbers, benzophenone UV absorbers, diphenyl acrylate UV absorbers, and amine UV absorbers.

The lamp cover is typically in the form of a plate with flat and smooth surface. However, when lens function is required at the same time, a textured pattern may be given to an inner surface (surface on the side of the light source) of the lamp cover, since lens function or retroreflective function can be obtained by the textured pattern. A lamp cover having a three dimensional curved surface may be used to improve outer appearance and design.

The lamp cover of the present invention is provided with a colored film or other colored member in non-light-emitting area thereof, that is, in non-light-transmissive area through which light emitted from the light source disposed in the lamp chamber is not transmitted, or such light needs not be transmitted.

The non-light-emitting area of the lamp cover may include various areas, but typically it is a peripheral area of the light emitting opening of the lamp chamber. Thus, non-light-emitting area is area surrounding a head lamp, a turn signal lamp, a back-up lamp, etc. These non-light-emitting area may have, together with the peripheral area of the light-emitting opening, typically an optional shape.

Figure 3:
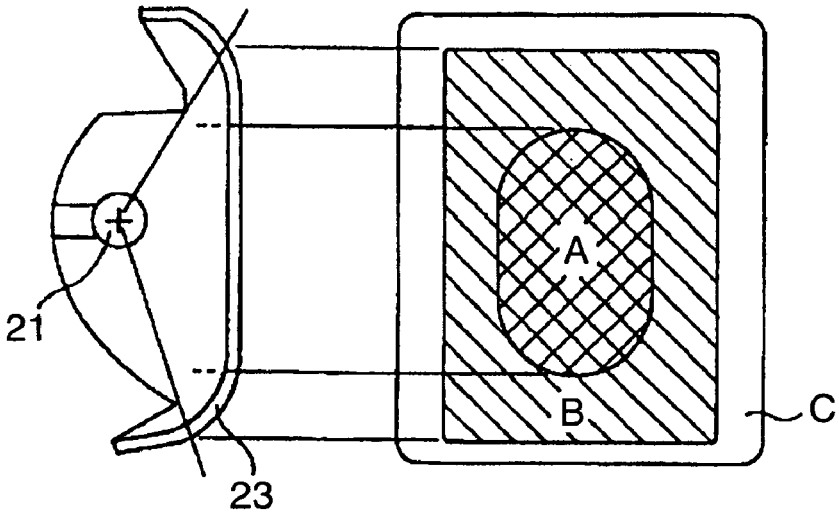
FIG. 3 is a schematic view useful for explaining non-light-emitting area of the automotive lamp according to the present invention.

The non-light-emitting area of the lamp cover may be defined, in accordance with Article 32 (Front light, etc.), of the Safety Regulation for Road Vehicles, Guideline for Inspection Practice (see 3-2 of 4-21), as referring to area excluding light portion, indicator portion, or reflector portion. Thus, in the schematic view in FIG. 3, the portion C obtained by excluding the lens portion A where luminosity is 98% of the center luminosity and the lens portion B where light is directly incident in the Figure, is the non-light-emitting area implied by the present invention.

In the present invention, the colored member is disposed in the lamp cover at a location which does not adversely affect the travel of light generated from the light source so that remarkable improvement of outer appearance and design can be achieved while ensuring compliance with the requirements of the Safety Regulation for Road Vehicles, etc.

The colored member used in the present invention needs to be a light-transmissive colored member such that, under unlit conditions, light L from outside (see FIG. 2) is transmitted to the housing 22, to be reflected by the inner wall 22*a*, to be thereby emitted again to outside as reflected light. Suitable colored members include, but are not limited to, the following:

(1) light-transmissive colored film, (2) colored coating formed by coating or applying a light-transmissive coloring paint to the outer or inner surface of the lamp cover, (3) light-transmissive colored resin sheet (for example acrylic plate, polycarbonate plate, etc.), (4) resin sheet (for example acrylic plate, polycarbonate plate, etc.) coated or applied with a light-transmissive coloring paint or laminated with a light-transmissive colored film, (5) colored resin molding molded integrally with the lamp cover and constituting a part of the cover.

Particularly useful colored member in the practice of the present invention is a colored film, and the most suitable colored film is a multi-layered film having at least a colored layer. Such a colored film may have additional layers as required, such as junction layer, support layer, base layer, adhesive layer, clear layer, and the like. For example, usually, the colored film is preferably applied to the lamp cover via an adhesive layer formed of a pressure sensitive adhesive or a heat sensitive adhesive. If the colored film is applied to an outer surface of the lamp cover, a clear layer is preferably provided as the outermost layer.

The colored film may be applied to an outer surface of the lamp cover, or may be applied to an inner surface of the lamp cover.

Figure 4:
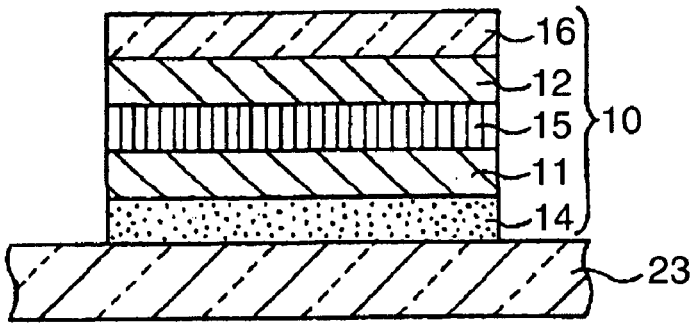
FIG. 4 is a cross-sectional view showing an exemplary use of a colored film in the lamp of the present invention.

FIG. 4 is a cross-sectional view showing an example of colored film applied to an outer surface of the lamp cover. The colored film 10 is composed of an adhesive layer 14, a first intermediate layer 11, a colored layer 15, a second intermediate layer 12 and a clear layer (surface layer) 16, in this order from the side of the lamp cover 23. The colored layer 15 may also serves as the first intermediate layer 11. Here, the first and second intermediate layers 11 and 12 are optional, and may respectively serve as a joint layer, a support layer, a base layer. These intermediate layers may be used as a single layer or as a laminate of two or more layers. In principle, the first and second intermediate layers 11 and 12 are colorless and transparent, or at least must not affect adversely the colored and light-transmissive design derived from the colored layer 15. Layers other than the colored layer 15 may be colored so that a novel colored and light-transmissive design can be achieved as a whole.

Figure 5:
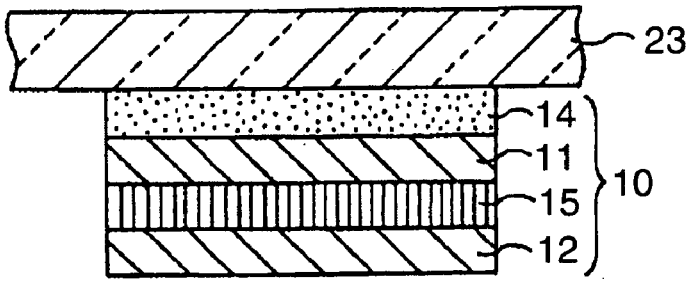
FIG. 5 is a cross-sectional view showing another exemplary use of a colored film in the lamp of the present invention.

FIG. 5 is a cross-sectional view showing an example of colored film applied to an inner surface of the lamp cover. The colored film 10 is composed of an adhesive layer 14, a first intermediate layer 11, a colored layer 15, and a second intermediate layer 12, in this order from the side of the lamp cover 23. Here, the first and second intermediate layers 11 and 12 are optional, and may respectively serve as a joint layer, a support layer, a base layer. These intermediate layers may be used as a single layer or as a laminate of two or more layers. In principle, the first and second intermediate layers 11 and 12 are colorless and transparent, or at least must not affect adversely the colored and light-transmissive design derived from the colored layer 15. Layers other than the colored layer 15 may be colored so that a novel colored and light-transmissive design can be achieved as a whole.

In the colored film of the present invention, the colored layer which is the main constituent of the film may be formed using various ordinary techniques for forming a thin film. Thus, the colored layer may be formed by printing, coating (including electrostatic spraying) of an ink or paint having a predetermined hue, or by coating, resin extrusion, or application of a film or sheet having a predetermined hue. Brightening agent such as pearl powder, metal powder, etc., or other additives may be added to the ink or paint. Preferably, the material used for forming the colored layer has, in addition to coloring property, excellent weather resistance which is a requirement for the lamp cover. Although thickness of the colored layer may be widely varied in accordance with desired effect in design, it is typically in the range of about 5 to 500 μm, and more preferably in the range of about 20 to 100 μm.

More specifically, in accordance with one aspect of the invention, the colored layer may be formed as a colored film of plastic material such as polyester film, polyethylene film, polycarbonate film, vinyl chloride film, acrylic film, polyurethane film, polyolefin film, vinylidene fluoride film. Plastic material may be used as a single resin, or as a mixture or copolymer of resins. A colored film can be manufactured, after suitable coloring agent is mixed with the resin raw material, by using ordinary molding method such as calendar molding to a desired film thickness.

In accordance with another aspect, the colored layer may be formed by manufacturing plastic film without mixing a coloring agent and then by coating the film with metal thin film to obtain a colored light-transmissive film.

The colored film is preferably provided with intermediate layers neighboring the colored layer in order to increase toughness of the film. The intermediate layer can function, for example, as a joint layer, a support layer, or a base layer. Suitable intermediate layers include, for example, a joint layer formed of polyurethane resin, or a base layer formed of polyester resin. These intermediate layer may be used as a single layer, or as a laminate of two or more layers.

In general, the colored film further comprises an adhesive layer for applying it to the lamp cover. The adhesive layer used for this purpose may be formed from adhesives typically used in the field of adhesive tapes and pressure sensitive adhesive tapes, for example, pressure sensitive type adhesive, heat sensitive type adhesive, light curing type adhesive. Suitable adhesives include, for example, pressure sensitive adhesives such as acrylic adhesives and rubber adhesives, and heat sensitive adhesives such as polyurethane adhesives and polyester adhesives. In particular, acrylic adhesives can be advantageously used in view of weather resistance. In the case of a pressure sensitive adhesive, the colored film is applied to the lamp cover by press-bonding, and in the case of a heat sensitive adhesive, the colored film is applied to the lamp cover simultaneously with heating, or is applied to the lamp cover heated in advance, or is press-bonded to the lamp cover and then heated together with the cover. In place of providing an adhesive layer in the colored film, the adhesive may be provided on the lamp cover in advance.

Thickness of the adhesive layer may be varied widely, but is typically in the range of about 10 to 500 μm, and preferably in the range of about 20 to 100 μm. If thickness of the adhesive layer is less than 10 μm, satisfactory adhesive strength cannot be obtained. If, on the contrary, thickness of the adhesive layer is more than 500 μm, thickness of the colored film as a whole becomes undesirably large. Indeed, when the colored film is applied to the outer surface of the lamp cover, it projects from the cover so that sense of harmonized appearance is impaired.

When the colored film of the present invention is used in the state of being applied to the outer surface of the cover film, the colored film preferably further comprises a clear layer as the outermost layer. In view of desired function as a protective film, it is desirable that the clear layer has weather resistance and heat resistance, in addition to its essential feature of clearness. It is also desirable that the clear layer has good adherence to the underlying layer. Suitable resins for forming the clear layer include, but are not limited to, polyester resins, polyethylene resins, polycarbonate resins, vinyl chloride resins, acrylic resins, polyurethane resins, polyolefin resins, fluororesins (PVdF, ETFE, etc.). These resins can also be used in a mixture or as a copolymer, as required. The clear layer can also give a gloss to the surface of the lamp cover, to thereby improve appearance.

In order to increase the weather resistance, the clear layer is preferably mixed with a UV absorber. Suitable UV absorbers include, but are not limited to, benzotriazole UV absorbers, benzophenone UV absorbers, cyanoacrylate UV absorbers.

Thickness of the clear layer may be varied widely, but is typically in the range of about 10 to 500 μm, and preferably in the range of about 20 to 100 μm. If thickness of the clear layer is less than 10 μm, satisfactory operative effect as a protective layer cannot be obtained. If, on the contrary, thickness of the clear layer is more than 500 μm, thickness of the colored film as a whole becomes too large to be used as a colored film.

As has been described before, the automotive lamp of the present invention is characterized in that a clear light-transmissive colored film or other colored member is provided in the area of the lamp cover other than the path of irradiated light. In a lamp having such construction, when the light source is lighted, irradiated light generated from the light source is emitted outward without being influenced by the colored member so that the proper function of the lamp is not adversely affected. On the other hand, under unlit conditions, external light incident through the colored member is colored by the colored member so that the inner wall of the housing or the lamp cover appears as colored when viewed through the cover. Needless to say, colored appearance can be observed when the interior of the housing is viewed through the colored member.

Although the automotive lamp of the present invention can exhibit the inventive effect in various lamps, it is particularly effective when applied to a head lamp in which an inner wall of the housing is formed in metallic tone by vapor deposition of aluminum, and which has a lamp cover with smooth front and back surfaces (that can be seen through) mounted thereon. If the peripheral portion of the cover, especially upper peripheral portion, where irradiated light of the head lamp does not pass, is provided with a colored member, under unlit conditions, the colored sunlight comes into the housing and is reflected at the vapor-deposited aluminum surface to give a glistening colored appearance. If the colored member is given a hue close to that of blue sky in fair weather, appearance as if reflecting blue sky can be obtained even in cloudy weather.

EXAMPLES

Now, the present invention will be described with reference to examples thereof. It is to be understood that the present invention is by no means restricted by these examples.

Examples 1 to 3 and Comparative Example 1

Three kinds of colored films that have the layer structure as shown in Tables 1 to 3 were prepared. The colored films 1 and 2 are specified to be applied to an outer surface of the lamp cover, and the colored film 3 is specified to be applied to an inner surface of the lamp cover.

TABLE 1

| Colored film 1 | | |
|---|---|---|
| clear layer | polyurethane, 50 μm thick | colorless, clear |
| colored layer | polyurethane, 50 μm thick | colored, clear (red) |
| adhesive layer | acrylic pressure sensitive adhesive, 30 μm thick | colorless, clear |

TABLE 2

| Colored film 2 | | |
|---|---|---|
| clear layer | polyurethane, 50 μm thick | colorless, clear |
| colored layer | polyurethane, 50 μm thick | colored, clear (blue) |
| adhesive layer | acrylic pressure sensitive adhesive, 30 μm thick | colorless, clear |

TABLE 3

| Colored film 3 | | |
|---|---|---|
| colored layer | polyurethane, 50 μm thick | colored, clear (blue) |
| adhesive layer | acrylic pressure sensitive adhesive, 30 μm thick | colorless, clear |

Here, a polyurethane coating that has been previously used in outdoor successfully in the field of automobile exterior finishing is used both as the colored layer and as the clear layer. In the case of the colored layer, the polyurethane coating was further colored in a predetermined hue. The adhesive layer was formed using acrylic pressure sensitive adhesive that has been previously used successfully in outdoor.

The obtained colored films were applied to a head lamp of a commercially available automobile of such type that the inner surface of the housing is formed in metallic tone by vapor deposition of aluminum, and the interior of the lamp chamber can be seen through a lamp cover (thickness: about 2 mm) that is flat and smooth both in front and back surfaces. In each of Examples, the colored film was press-bonded only to non-light-emitting area (the cover surface outside the path of irradiated light) provided around light-emitting area of the lamp cover. The colored film was applied to the following location:

Example 1: outer surface of the lamp cover

Example 2: outer surface of the lamp cover

Example 3: inner surface of the lamp cover

Comparative Example 1: no colored film was applied.

Outer appearance of the obtained lamp was observed in daytime (under unlit conditions) and at night (under lit conditions), and observation result as shown in Table 4 below was obtained.

TABLE 4

| Example No. | Daytime: observed under unlit conditions | Night: observed under lit conditions |
|---|---|---|
| Example 1 | Interior of the housing appears red with external light | Irradiated light is not colored nor dimmer than the lamp of Comparative example 1 |
| Example 2 | Interior of the housing appears blue with external light | Irradiated light is not colored nor dimmer than the lamp of Comparative example 1 |
| Example 3 | Interior of the housing appears blue with external light | Irradiated light is not colored nor dimmer than the lamp of Comparative example 1 |
| Comparative Example 1 | Not colored | — |

From the observation result shown in Table 4 above, it can be seen that remarkably improved appearance and design is achieved in accordance with the present invention.

As has been described before, in accordance with the present invention, there is provided an automotive lamp which is excellent in appearance and design without violating current regulations, and which is simple in design and easy to be manufactured.

I claim:

1. An automotive lamp comprising a light source, a housing provided with an inner wall capable of reflecting light generated from the light source, a light-emitting opening provided in a front area of the housing, and a light-transmissive lamp cover mounted in the light emitting opening, wherein a light-transmissive colored member is disposed within a non-light-emitting area of the lamp cover, and light emitted from the light source does not transmit through the light-transmissive colored member so that light emitted from the light source is not influenced by the light-transmissive colored member and external light is transmitted through the light-transmissive colored member to the housing and reflected at the inner wall of the housing and emitted out of the housing.

2. An automotive lamp according to claim 1, wherein the light-transmissive colored member is, a light-transmissive colored film, or a coating of light-transmissive coloring paint, or a light-transmissive colored resin sheet or a resinous sheet coated with a light-transmissive coloring paint, or a resinous sheet laminated with a light-transmissive colored films, or a molded article of the colored resin constituting a part of the lamp cover.

3. An automotive lamp according to claim 2, wherein the colored film is a multi-layered film containing at least a colored layer.

4. An automotive lamp according to claim 2, wherein an outer surface of the lamp cover has the colored film adhered thereto.

5. An automotive lamp according to claim 2, wherein an inner surface of the lamp cover has the colored film adhered thereto.

6. An automotive lamp according to claim 2, wherein the colored film further comprises an adhesive layer of an acrylic adhesive.

7. An automotive lamp according to claim 2, wherein, when the colored film is adhered to an outer surface of the lamp cover, the colored film further comprises a clear layer as the outermost layer of the lamp cover.

8. An automotive lamp according to claim 3, wherein an outer surface of the lamp cover has the colored film adhered thereto.

9. An automotive lamp according to claim 3, wherein an inner surface of the lamp cover has the colored film adhered thereto.

10. An automotive lamp according to claim 3, wherein the colored film further comprises an adhesive layer of an acrylic adhesive.

11. An automotive lamp according to claim 4, wherein the colored film further comprises an adhesive layer of an acrylic adhesive.

12. An automotive lamp according to claim 5, wherein the colored film further comprises an adhesive layer of an acrylic adhesive.

13. An automotive lamp according to claim 3, wherein, when the colored film is adhered to an outer surface of the lamp cover, the colored film further comprises a clear layer as the outermost layer of the lamp cover.

14. An automotive lamp according to claim 4, wherein, when the colored film is adhered to an outer surface of the lamp cover, the colored film further comprises a clear layer as the outermost layer of the lamp cover.

15. An automotive lamp according to claim 6, wherein, when the colored film is adhered to an outer surface of the lamp cover, the colored film further comprises a clear layer as the outermost layer of the lamp cover.

* * * * *